US010453584B2

(12) United States Patent
Kobilka et al.

(10) Patent No.: US 10,453,584 B2
(45) Date of Patent: Oct. 22, 2019

(54) HYDROPHOBIC, CONDUCTIVE ORGANIC MATERIALS FOR METALLIC SURFACES

(71) Applicant: International Business Machines Corporation, Armonk, NY (US)

(72) Inventors: Brandon M. Kobilka, Tucson, AZ (US); Joseph Kuczynski, North Port, FL (US); Jacob T. Porter, Highland, NY (US); Jason T. Wertz, Pleasant Valley, NY (US)

(73) Assignee: International Business Machines Corporation, Armonk, NY (US)

( * ) Notice: Subject to any disclaimer, the term of this patent is extended or adjusted under 35 U.S.C. 154(b) by 233 days.

(21) Appl. No.: 15/335,859

(22) Filed: Oct. 27, 2016

(65) Prior Publication Data

US 2018/0122531 A1 May 3, 2018

(51) Int. Cl.

| | |
|---|---|
| ***H01B 1/12*** | (2006.01) |
| ***C23C 30/00*** | (2006.01) |
| ***C23C 26/00*** | (2006.01) |

(52) U.S. Cl.

CPC ..... *H01B 1/12* (2013.01); *C23C 26/00* (2013.01); *C23C 30/00* (2013.01)

(58) Field of Classification Search

CPC ..... H01B 1/12

See application file for complete search history.

(56) References Cited

U.S. PATENT DOCUMENTS

| | | | | |
|---|---|---|---|---|
| 8,187,707 | B2 | 5/2012 | Van Benthem et al. | |
| 8,236,422 | B2 | 8/2012 | Williams et al. | |
| 9,950,318 | B2 | 4/2018 | King et al. | |
| 10,259,951 | B2 | 4/2019 | Kobilka et al. | |
| 2009/0317590 | A1 | 12/2009 | Hwang et al. | |
| 2012/0208086 | A1* | 8/2012 | Plieth | B82Y 30/00 429/213 |

FOREIGN PATENT DOCUMENTS

| | | | |
|---|---|---|---|
| CN | 102102168 | B | 6/2012 |
| CN | 102755951 | B | 8/2014 |
| CN | 103966643 | A | 8/2014 |
| CN | 103464070 | B | 4/2015 |
| CN | 105734569 | A | 7/2016 |
| WO | WO 2015/010464 | A1 | 1/2015 |

OTHER PUBLICATIONS

K. Hübner et al., *Ionicity and Electrical Conductivity in Transition-Metal Oxides*, physica status solidi (b), vol. 68, Issue 2, Apr. 1, 1975, 5 pages.

(Continued)

*Primary Examiner* — William P Watkins, III

(74) *Attorney, Agent, or Firm* — Peter Edwards

(57) ABSTRACT

A process of forming a hydrophobic, conductive barrier on a metallic surface includes coating the metallic surface with an organic, conductive material. The organic, conductive material includes a conductive group having two or more alkyne groups and a terminal thio group to bind the organic, conductive material to the metallic surface.

20 Claims, 4 Drawing Sheets

(56) References Cited

OTHER PUBLICATIONS

Blum et al., *Molecularly inherent voltage-controlled conductance switching*, nature materials, vol. 4, htttp://www.nature.com/naturematerials (online), Nature Publishing Group, published online: Jan. 16, 2005, 7 pages.

Mamardashvili et al., *Solubility of Alkylporphyrins*, Molecules, http://www.mdpi.org/molecules/papers/50600762.pdf (online), ISSN 1420-3049, published Jun. 7, 2000, 5 pages.

Akay et al., *Preparation of Nanostructured Microporous Metal Foams through Flow Induced Electroless Deposition*, Journal of Nanomaterials, vol. 2015, Article ID 275705, http://dx.doi.org/10.1155/2015/275705, Hindawi Publishing Corporation, dated 2015 (month unknown), 18 pages.

Kazimierz Conder, *Electronic and Ionic Conductivity in Metal Oxides*, Laboratory for Developments and Methods, Paul Scherrer Institut (PSI), http://collaborations.fz-juelich.de/ikp/cgswhp/cgswhp12/program/files_batumi/14-08-2012/Parallel_Session_5/1_Kazimierz.Conder_Batumi.pdf (online), printed Aug. 2, 2016, 44 pages.

Rinnerbauer et al., *Nanoimprinted superlattice metallic photonic crystal as ultra-selective solar absorber*, Optical Society of America, vol. 2, Issue 8, doi: 10.1364/OPTICA.2.000743, OSA Publishing, dated 2015, 4 pages.

Liu et al., *Lattice-Directed Formation of Covalent and Organometallic Molecular Wires by Terminal Alkynes on Ag Surfaces*, http://ww.acsnano.org (online), DOI: 10.1021/acsnano.5b01803, Source PubMed, ACS Nano, vol. 9, No. 6, dated May 2015, 11 pages.

*Surface Tension*—(*Wikipedia*), Physical Chemistry Laboratory, School of Chemistry, http://www.tau.ac.il/~phchlab/experiments_new/surface_tenstion/theory.html (online), printed Jul. 28, 2016, 7 pages.

Nick Kacsandi, *Manufacturing a Porous, Hydrophobic Metallic Surface*, https://ninesights.ninesigma.com/rfps/-/rfp-portlet/rfpViewer/3010?utm_source=SilverpopMailing&utm_medium=email&utm_campaign=REQ1301074%20-%20Manufacturing%20a%20Porous%20Hydrophobic%20Metallic%20Surface%20-%20Extension%20%281%29&utm_content=&spMailingID=24506005&spUserID=MTAyNjMyODUzMzA1S0&spJobID=722535030&spReportId=NzlyNTM1MDMwS0 (online), NineSights, NineSigma, printed Jul. 28, 2016, 3 pages.

Bruce et al., "*Valence Band Dependent Charge Transport in Bulk Molecular Electronic Devices Incorporating Highly Conjugated Multi-*[(*Porphinato)Metal*] *Oligomers*", Journal of the American Chemical Society, Feb. 2016, vol. 138, Issue 7, pp. 2078-2081, American Chemical Society (acs.org) online, DOI: 10.1021/jacs.5b10772, URL: pubs.acs.org/doi/abs/10.1021/jacs.5b10772.

Dong et al., "Investigation on the antibacterial micro-porous titanium with silver nano-particles.," J Nanosci ganotechnol, Oct. 2013;13(10):6782-6, Abstract Only, 1 page, http://www.ncbi.nlm.nih.gov/pubmed/24245143.

* cited by examiner

HYDROPHOBIC, CONDUCTIVE ORGANIC MATERIALS FOR METALLIC SURFACES

BACKGROUND

Micro-porous and nano-porous metallic surfaces and membranes have a wide variety of uses ranging from antibacterial surfaces to catalytic microreactors to photonic absorbers. These applications span a broad range of industries and consumer goods. Variations in the nanoscale characteristics of a functional surface may have a significant impact on performance characteristics, such as conductivity, in some applications. To illustrate, minor alterations in contact angle, porosity, and patterning may result in significant impacts on particular performance characteristics.

SUMMARY

According to an embodiment, a process of forming a hydrophobic, conductive barrier on a metallic surface is disclosed. The process includes coating the metallic surface with an organic, conductive material. The organic, conductive material includes a conductive group including two or more alkyne groups and a terminal thio group to bind the organic, conductive material to the metallic surface.

According to another embodiment, an article of manufacture is disclosed that includes a metallic material and an organic, conductive material disposed on a surface of the metallic material. The organic, conductive material includes a conductive group and a terminal thio group. The conductive group including two or more alkyne groups, and the terminal thio group binds the organic, conductive material to the metallic surface. The organic, conductive material forms a hydrophobic, conductive barrier on the surface of the metallic material.

According to another embodiment, a process of forming an article of manufacture having a porous, hydrophobic metallic surface is disclosed. The process includes forming a porous metallic material and coating the porous metallic material with an organic, conductive material to form a hydrophobic, conductive barrier on a surface of the porous metallic material. The organic, conductive material includes a conductive group having two or more alkyne groups and a terminal thio group to bind the organic, conductive material to the surface of the porous metallic material.

The foregoing and other objects, features and advantages of the invention will be apparent from the following more particular descriptions of exemplary embodiments of the invention as illustrated in the accompanying drawings wherein like reference numbers generally represent like parts of exemplary embodiments of the invention.

DETAILED DESCRIPTION

Figure 1:
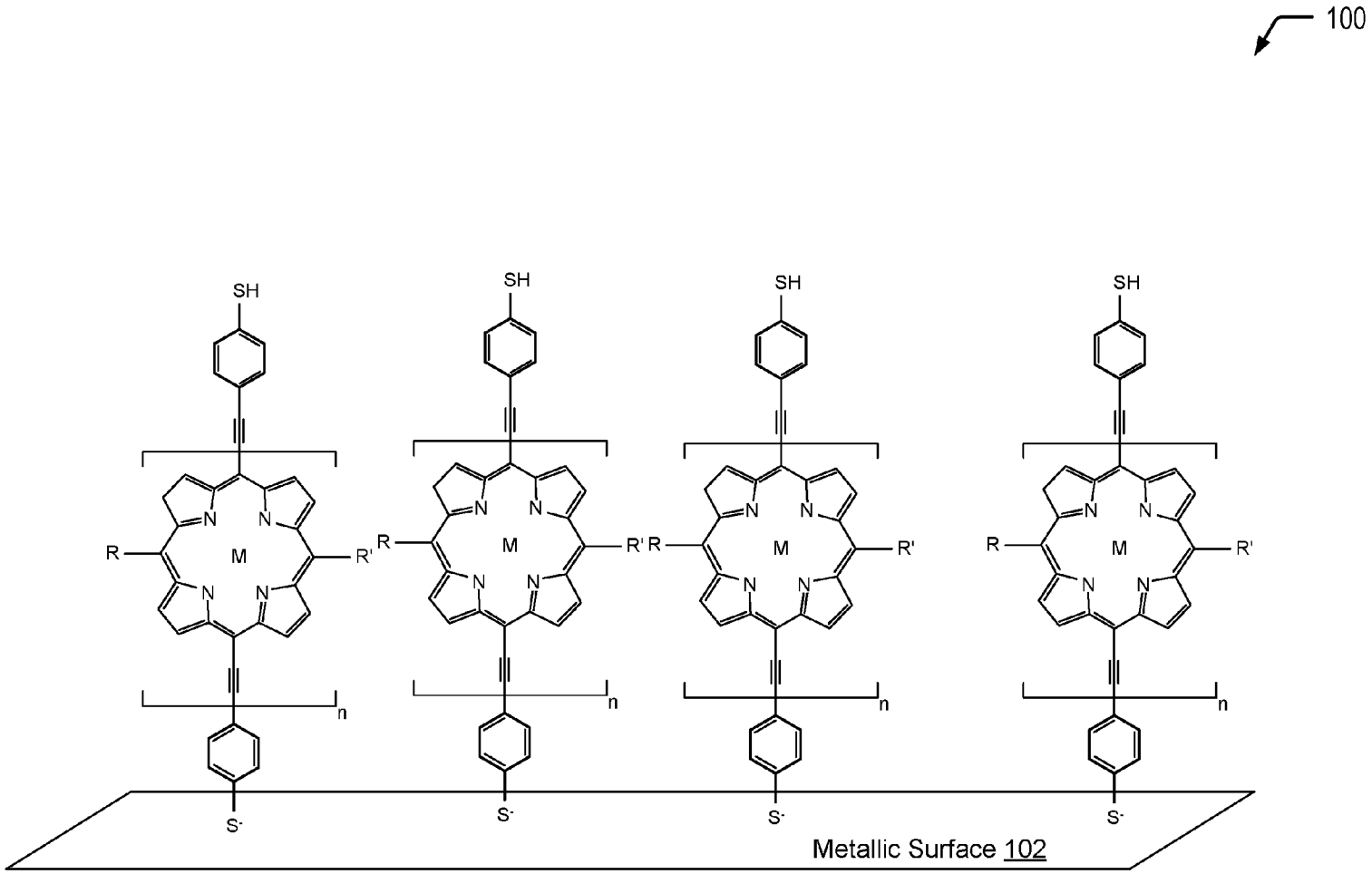
FIG. 1 is a diagram illustrating a metallic surface that is coated with an organic, conductive material to form a hydrophobic, conductive barrier on the metallic surface, according to one embodiment.

The present disclosure describes organic, conductive materials that may be utilized as a coating material that may act as a hydrophobic, conductive barrier on a metallic surface, among other possible applications. In an example application, the organic, conductive materials of the present disclosure may be utilized in a process of manufacturing a porous, hydrophobic metallic surface that satisfies particular performance characteristics. For example, the organic, conductive materials of the present disclosure may be used to generate a micro-porous and hydrophobic metallic surface that can withstand alkaline environments.

As an illustrative, non-limiting example, a metallic surface (e.g., nickel) that is coated with the organic, conductive material(s) of the present disclosure may have a surface that exhibits a "mesh" of apertures no larger than 5-10 micrometers in size, a contact angle greater than 120° (e.g., 150°), and may be permeable to gases/non-aqueous mixtures, but not aqueous mixtures. While electropotential deposition techniques have been utilized to form conductive, microporous metallic surfaces that also exhibit hydrophobicity, there may be challenges associated with imparting such characteristics via such deposition techniques.

The techniques described herein represent an alternative approach that does not use electrodeposition. In particular, utilizing the organic, conductive material(s) of the present disclosure to coat a metallic surface may overcome challenges associated with attempts to impart such characteristics via electrodeposition techniques. Typically, conductive coatings display varying degrees of hydrophilicity. The present disclosure describes methods to generate a hydrophobic metallic surface with tunable pore sizes ranging from the nanoscale to the macroscale that does not use electrodeposition techniques.

Highly conjugated multi-[(porphinato)metal] oligomers have been utilized as conductive molecular wires (e.g., in the context of gold substrates). Electrons may be driven from the conduction band of a metallic substrate through the porphinato metal complex via overlap of the extensive pi clouds of the organometallic complex with the metal conduction band. Such molecular wires serve to enable conduction perpendicular to the metal surface. A similar concept has been demonstrated using bipyridyl-dinitro oligophenyleneethynylene dithiol (BPDN) as a molecular switch (e.g., in the context of gold substrates). Further, terminal alkynes may be used to bind similar molecular wires to other metals (e.g., silver).

Dithiocarbamate linkers have been utilized to bind conjugated organic molecules to nanoparticles (quantum dots) and to achieve overlap of charged particles and excitons (via overlapping wave functions) from the organic molecule to the nanoparticle and vice versa. In one embodiment, the organic, conductive material of the present disclosure may include a porphinato metal complex having a terminal thio group. In another embodiment, the organic, conductive material of the present disclosure may include BPDN that is modified to include at least one terminal dithiocarbamate group. In yet another embodiment, the organic, conductive material of the present disclosure may include terminal alkyne groups and at least one dithiocarbamate group. These conductive organic molecules can be bound to a variety of metallic surfaces/particles to maintain conductivity and to impart hydrophobicity.

As described further herein, in a particular embodiment, porous metallic surfaces may be generated using techniques that utilize plastic nano or microbeads to create a lattice. The lattice is then infused with the desired metal, and the plastic lattice is removed via high temperature degradation, dissolved, or oxidized by washing with common solvents. Functionalization with dithiocarbamate serves two purposes. The dithiocarbamate allows the conducting molecule to bind to the metallic surface and simultaneously allows charge transfer to occur from the organic molecule to the metallic particle. After synthesis of the conductive molecules, the conductive molecules may be deposited onto the metallic particles via solution deposition techniques. This process may be done either before or after the metal particles are applied to the latex/plastic matrix.

Referring to FIG. 1, a diagram 100 depicts an example of a metallic surface 102 that is coated with an organic, conductive material to form a hydrophobic, conductive barrier on the metallic surface 102. In the example of FIG. 1, the organic, conductive material includes a porphinato metal complex having a terminal thio group. The thio group of the organometallic material of FIG. 1 binds to the metallic surface 102 and simultaneously allows charge transfer to occur from the organometallic material to the metallic surface 102. In a particular embodiment, the metallic surface 102 of FIG. 1 may be a porous metallic surface that may be generated using techniques that utilize plastic nano or microbeads to create a lattice.

FIG. 1 depicts an example of a highly conjugated multi-[(porphinato)metal] oligomer. Electrons can be driven from the conduction band of the metallic surface 102 through the porphinato metal complex via overlap of the extensive pi clouds of the organometallic complex with the metal conduction band. In the example of FIG. 1, the organometallic complex is bound to the metallic surface 102 via a terminal thio group, while a thiol group is present on the other side of the organometallic complex. While not shown in the example of FIG. 1, in some cases, one or more of the terminal thio groups may include a dithiocarbamate group (similar to the dithiocarbamate groups depicted in the embodiments of FIGS. 2 and 3). In some cases, the terminal sulfur group of the organometallic complex that binds the organometallic complex to the metallic surface 102 may be replaced with a dithiocarbamate group (e.g., via an asymmetric substitution reaction to add a single terminal dithiocarbamate group). In other cases (e.g., in the event that asymmetric substitution is more difficult than a symmetric substitution reaction), the terminal sulfur groups on each end of the organometallic complex may be replaced with dithiocarbamate groups.

In the embodiment depicted in FIG. 1, two alkyl groups are depicted at positions $R_{20}$ and $C_{10}$ of the porphinato metal complex. The first alkyl group at the $C_{20}$ position is designated as R, and the second alkyl group at the $C_{10}$ position is designated as R'. In some cases, different alkyl chains may be selected in order to modify the solubility of the porphyrin. The alkyl chains may be bonded to the porphyrin prior to bonding the porphyrin to the metallic surface 102 through chemical synthesis. The alkyl chains (R and R') may not affect the planarity conductivity along the porphyrin backbone and, in some cases, may improve the conductivity (e.g., poly(alkylthiophene)s, among other alternatives). In some cases, the alkyl chains may be modified by switching butoxy groups on the benzenes that flank the porphyrin. This may be accomplished by using different starting alkyl or alkoxy benzaldehydes in the first step of the porphyrin synthesis described below. The positions of the alkyl groups may vary, and there may be various numbers of the alkyl groups on the benzene ring (e.g., 1, 2, or 3 groups). Alternatively, alkylprryole-type groups may be used to synthesize alkylporphyrins.

Prophetic Example: Synthetic Procedure

Step 1: Formation of 15-Bis(alkoxyphenyl)porphyrin. Dipyrrylmethane (1.0 eq.) and alkoxybenzaldehyde (1.05 eq.) may be dissolved in methylene chloride under an argon atmosphere. The solution may be deaerated and boron trifluoride etherate (7.5 mol %) may be added. The mixture may be stirred at room temperature for 3 h, quenched with 2,3-dichloro-5,6-dicyano-1,4-benzoquinone (DDQ) (1.5 eq.), and stirred for an additional 1 hour. The solvents may be removed in vacuo and the resulting black residue re-dissolved in a minimal amount of methylene chloride, filtered through a silica plug and evaporated. The product may be purified further via column chromatography.

Step 2: Formation of 5,15-Dibromo-10,20-bis(alkoxyphenyl)porphyrin. The bis(alkoxyphenyl)porphyrin from the previous step may be dissolved in chloroform and cooled to 0° C. N-bromosuccinimide (NBS) (3.0 eq.) may be added. The equivalents of NBS can be adjusted from 1 to an excess (e.g., 3) to give either the monobromo or dibromo materials. The monobromo may be used as the oligomer/polymer "end capper," and the dibromo may be used for the oligomer polymer. After stirring at 0° C. for 30 min, the reaction may be quenched with an excess of acetone. The solvents may be removed in vacuo and subsequently purified by column chromatography using 1:1 chloroform:hexanes as the eluant, resulting in the product 5,15-Dibromo-10,20-bis(2',6'-bis(3,3-dimethyl-1-butyloxy)phenyl)porphyrin.

Step 3: Formation of [5,15-Dibromo-10,20-bis(alkoxyphenyl)porphinato]zinc(II). To a stirred solution of the porphyrin from the previous reaction (1.0 eq.) in chloroform may be added zinc(II) acetate (8 eq.), and the reaction mixture may be refluxed for 3 h. After cooling to room temperature, the solution may be washed with water, separated, and the solvents may be removed in vacuo. The residue may be re-dissolved in a minimal amount of 85:15 hexanes/THF and purified by column chromatography using an eluant of the same composition.

Step 4: Formation of [5,15-Bis-trimethylsilylethynyl-10,20-di(alkoxyphenyl)porphinato]zinc(II). The porphyrin from the previous step (1 eq.), trimethylsilylethynylzinc chloride (e.g., 2.5 eq.) may be dissolved in anhydrous THF (0.45 M), and placed under an argon atmosphere. The number of equivalents may be adjusted based on which bromo-porphyrin is being reacted, but an excess may be used in any case. The solution may be degassed via three freeze-pump-thaw cycles, followed by the addition of $Pd(PPh_3)_4$ (10 mol %). The reaction may be stirred at 60° C. for 24 hours, cooled to room temperature, and the solvents may be removed in vacuo. The residue may be re-dissolved in THF and adsorbed to an excess of silica. The product may be purified by column chromatography on silica using 15:85 THF/hexanes as the eluent.

Subsequent Steps: Deprotection

Deprotection of Silychloride from alkynes: To a solution of the tetrazine in an organic solvent which may include chloroform, chlorobenzene, etc. may be added an alkylsulfite fluoride and a 1 M solution of TBAF in THF, and the reaction mixture may be stirred at reflux for 24 hours. The reaction may be cooled to room temperature and may be precipitated into hexane, and filtered. The crude solid may be recrystallized from a mixture of solvents that may include methanol, ethanol, and/or acetone, hexane, dichloromethane, chloroform.

The dibromoporphyrin (50 mg, 4.13×10 5 mol) and the bisalkynyl porphyrin 17 (47.4 mg, 1.65×10 5 mol) may be charged into a Schlenk flask with $Pd_2dba_3$ (5.7 mg, 4.95×10 6 mol) and $AsPh_3$ (12.1 mg, 3.96×10 5 mol). A 9:1 THF:TEA solvent mixture may be degassed with an Ar purge for 30 min and transferred to the Schlenk flask. The reaction mixture may be stirred at 60° C. overnight. The monobromo-monosilyl-protected-alkylnylporphyrin may be added to "end-cap" the oligoporphyrin or may be used in an additional, separate reaction with similar reaction conditions. The solvents may be removed in vacuo and the crude residue may be purified by chromatographed on silica using 49:1 $CHCl_3$:MeOH as the eluent. The product band may be collected, evaporated, taken up in THF, and purified via size exclusion chromatography (BioRad Biobeads, SX-1).

Additional deprotection step may be performed under similar conditions to those above. The dithioic acid group may be synthesized symmetrically or unsymmetrically, through careful stoichmetric control, however, symmetric synthesis should be easier and work in higher yields. Terminal, unreacted alkynes can be reacted with either a strong base such as n-butyllithium or methylmagnesium chloride under anhydrous conditions, followed by the addition of carbon disulfide. A milder amine base, such as triethylamine, may be added after the addition of the strong base to increase reaction yields. The thiol group may be synthesized by reacting the oligoporphryin with either 1-iodo-4-acetylthiobenzene or 1-bromo-4-acetylthiobenzene under Sonogashira cross-coupling conditions, followed by the deprotecting of the thioacetate under basic or acidic conditions.

An example of a process of forming a porous, metallic surface may include establishing a lattice matrix by depositing plastic particles onto a desired surface. The plastic that is used in the lattice particles can be latex, other polymers with relatively low decomposition temperatures, or those with satisfactory solubility in common solvents. As an illustrative, non-limiting example, the plastic nano or microbeads may include a polystyrene material. In other cases, alternative and/or additional polymeric material(s) may be used in the spheres to create a lattice or matrix for the metallic particles. Other polymeric materials with similar or lower decomposition temperature profiles include polyethylene, poly(vinyl alcohol), polybutadiene, ABS copolymer, polyisoprene, polypropylene, poly(methyl methacrylate), polyacetals, and poly(vinyl chloride), among other alternatives. The lattice is then infused with the desired metal (e.g., nickel), and the plastic lattice is removed via high temperature degradation, dissolved, or oxidized by washing with common solvents.

The plastic particle size can also be chosen to control the size of the voids (or final pore size) in the lattice and can range from the micro-scale to the nano-scale. The plastic matrix is then infused with the desired metal. This may be accomplished by filtering an aqueous colloidal solution of metallic particles through the plastic matrix until the matrix is saturated with the metallic particles. This porous surface-forming procedure can be applied directly on the desired surface. The resulting composite is then dried, and the plastic is removed via thermal degradation processes (e.g., including calcination) at elevated temperature. In order to limit the cracking of the film, it is desirable to remove all of the solvent from the filtration step prior to calcination and thermal degradation of the plastic. This can be accomplished by raising the metal infused matrix to a temperature sufficient to evaporate the solvent slowly without excessive or violent boiling. After the solvent has been removed, the calcination procedure can be carried out to remove the plastic particles. Alternative procedures for removal of the plastic include, but are not limited to, dissolution in common solvents (e.g., chloroform or THF), and oxidation with aqueous acid.

After synthesis of the organometallic complex including the terminal thio groups depicted in FIG. 1, the organometallic complex may be deposited onto the metallic particles via solution deposition techniques. This process can be performed either before or after the metal particles are applied to the latex/plastic matrix. The conducting molecules bind to the metallic surface/particles through the thio group(s).

Thus, FIG. 1 illustrates an example of a metallic surface that is coated with a conductive, organic material of the present disclosure to form a hydrophobic, conductive barrier on the metallic surface. In a particular embodiment, the metallic surface (e.g., nickel) that is coated with the organometallic complex having the terminal thio group(s) may have a surface that exhibits a "mesh" of apertures no larger than 5-10 micrometers in size, a contact angle greater than 120° (e.g., 150°), and may be permeable to gases/non-aqueous mixtures but not aqueous mixtures.

Figure 2:
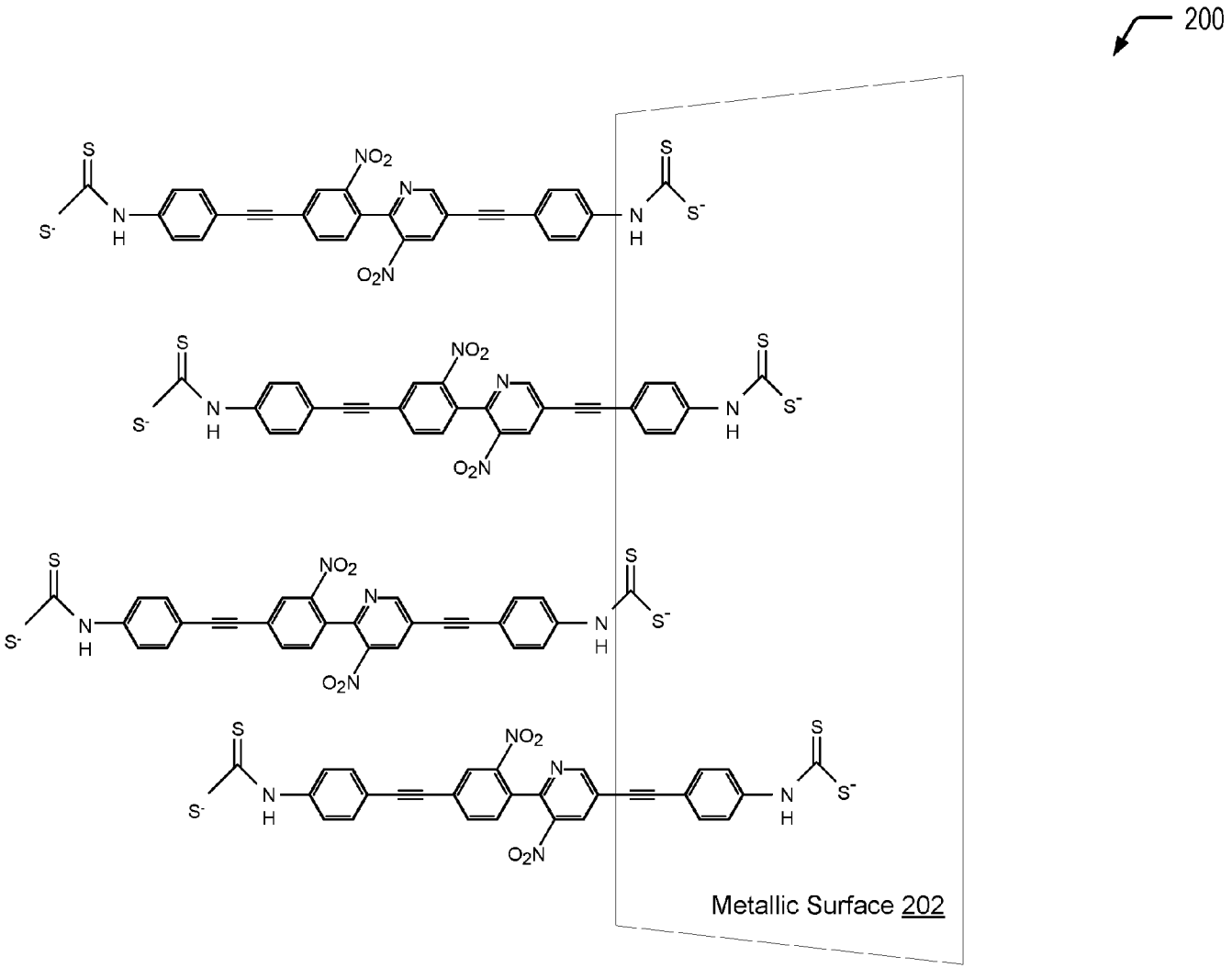
FIG. 2 is a diagram illustrating a metallic surface that is coated with an organic, conductive material to form a hydrophobic, conductive barrier on the metallic surface, according to one embodiment.

Referring to FIG. 2, a diagram 200 depicts an example of a metallic surface 202 that is coated with an organic, conductive material of the present disclosure to form a hydrophobic, conductive barrier on the metallic surface 202. In the example of FIG. 2, the organic, conductive material includes a BPDN molecule that is modified to replace one or more of the terminal thiol groups with one or more terminal dithiocarbamate groups. The dithiocarbamate group of the organic, conductive material of FIG. 2 binds to the metallic surface 202 and simultaneously allows charge transfer to occur from the conductive, organic material to the metallic surface 202. In a particular embodiment, the metallic surface 202 of FIG. 2 may be a porous metallic surface that may be generated using techniques previously described herein with respect to FIG. 1.

FIG. 2 depicts an example of an organic, conductive material that is chemically similar to bipyridyl-dinitro oligophenyleneethynylene dithiol (BPDN) with one or more of the terminal thiol groups replaced with one or more dithiocarbamate groups. Electrons can be driven from the conduction band of the metallic surface 202 through the BPDN-derived organic material via overlap of the extensive pi clouds of the organic material with the metal conduction band. In the example of FIG. 2, one of the terminal thiol groups of a BPDN molecule is replaced with a dithiocarbamate group. In other cases, the second thiol group of the BPDN molecule may be replaced with another dithiocarbamate group (e.g., in the event that an asymmetric substitution reaction to add a single terminal dithiocarbamate group is more difficult than a symmetric substation reaction to form terminal dithiocarbamate groups on each end of the molecule).

Prophetic Example: Synthetic Procedure

Step 1: Bromination of 2,2'-dinitrobiphenyl. To a dried screw-capped tube may be added 2,2'-dinitrobiphenyl (1.0 eq.) and silver acetate (2.4 eq.). Glacial acetic acid (excess), sulfuric acid (3.8 eq.), and bromine (3.0 eq.) may be sequentially added. The reaction vessel may be capped and heated to 80° C. for 16 hours. The reaction mixture may then be cooled and poured into ice water. The solid material may be collected by filtration. The desired material may be purified by column chromatography with an eluent of 1:1 methylene chloride/hexanes.

Step 2: Sonogashira coupling of molecule from previous step with TMS-acetylene. To a dried round bottom flask or to a screw cap pressure tube may be added an aryl halide, a palladium catalyst such as bis(triphenylphosphine)palladium(II) dichloride (3-5 mol % per halide), and copper(I) iodide (6-10 mol % per halide). The reaction vessel may then be under a $N_2$ atmosphere. A solvent system of THF and/or benzene and/or methylene chloride may be added, and may be followed by the addition of triethylamine or diisopropylethylamine, Lastly, the terminal alkyne (1-1.5 mol % per halide) may be added, and the reaction may be heated until complete. The reaction mixture may be poured into water, a saturated solution of $NH_4Cl$, or brine. The organic layer may be diluted with methylene chloride or $Et_2O$ and washed with water, a saturated solution of $NH_4Cl$, or brine (3×). The combined aqueous layers may be extracted with methylene chloride or $Et_2O$ (2×). The combined organic layers may be dried over $MgSO_4$ and the solvent removed in vacuo to afford the crude product, which may be purified by column chromatography and may use a mixture of hexane and methylene chloride as the eluent.

Step 3: Deprotection of silyl groups from alkynes. To a stirred solution of the silylated alkyne from the previous step dissolved in an organic solvent such as methanol or tetrahydrofuran may be added potassium carbonate or 1.0 M tetrabutylammonium fluoride (TBAF) in THF. The mixture may be stirred at room temperature and may be poured into water. The solution may be extracted with ether or ethyl acetate and washed with brine. The solution may be dried over magnesium sulfate, and the solvent may be removed in vacuo. The crude product may require no further purification or may be purified by chromatography using a mixture of hexane and methylene chloride as the eluent.

Step 4: Sonogashira of coupling to affix either the aniline (thiocarbamate precursor), or acetate protected thiol to molecule from previous step. To a dried round bottom flask or to a screw cap pressure tube may be added an aryl halide, a palladium catalyst such as bis(triphenylphosphine)palladium(II) dichloride (3-5 mol % per halide), and copper(I) iodide (6-10 mol % per halide). The reaction vessel may then be under a $N_2$ atmosphere. A solvent system of THF and/or benzene and/or methylene chloride may be added, and may be followed by the addition of triethylamine or diisopropylethylamine. Lastly, the terminal alkyne (1-1.5 mol % per halide) may be added, and the reaction may be heated until complete. The reaction mixture may be poured into water, a saturated solution of $NH_4Cl$, or brine. The organic layer may be diluted with methylene chloride or $Et_2O$ and washed with water, a saturated solution of $NH_4Cl$, or brine (3×). The combined aqueous layers may be extracted with methylene chloride or $Et_2O$ (2×). The combined organic layers may be dried over $MgSO_4$ and the solvent removed in vacuo to afford the crude product, which may be purified by column chromatography and may use a mixture of hexane and/or methylene chloride as the eluent.

After synthesis of the BPDN-derived organic molecules depicted in FIG. 2, the conductive, organic molecules may be deposited onto the metallic particles via solution deposition techniques. This process can be performed either before or after the metal particles are applied to the latex/plastic matrix. The conducting molecules bind to the metallic surface/particles through the dithiocarbamate group(s).

Thus, FIG. 2 illustrates an example of a metallic surface that is coated with a conductive, organic material of the present disclosure to form a hydrophobic, conductive barrier on the metallic surface. In a particular embodiment, the metallic surface (e.g., nickel) that is coated with the BPDN-derived molecules having the terminal dithiocarbamate group(s) may have a surface that exhibits a "mesh" of apertures no larger than 5-10 micrometers in size, a contact angle greater than 120° (e.g., 150°), and is permeable to gases/non-aqueous mixtures but not aqueous mixtures.

Figure 3:
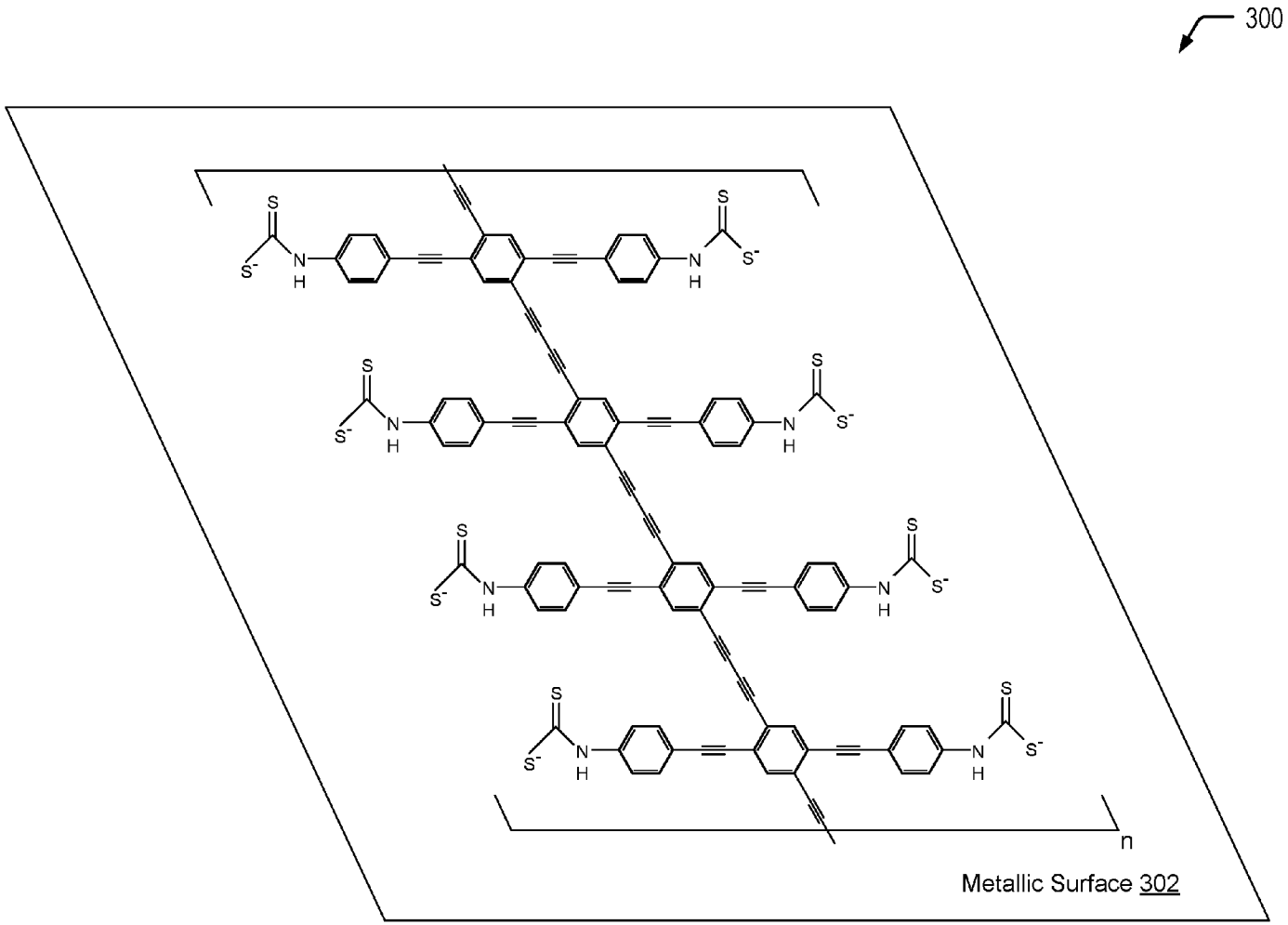
FIG. 3 is a diagram illustrating a metallic surface that is coated with an organic, conductive material to form a hydrophobic, conductive barrier on the metallic surface, according to one embodiment.

Referring to FIG. 3, a diagram 300 depicts an example of a metallic surface 302 that is coated with a conductive, organic material to form a hydrophobic, conductive barrier on the metallic surface 302. In the example of FIG. 3, the organic, conductive material is similar to the BPDN-derived material depicted in FIG. 2, with terminal alkyne groups that enable polymerization on the metallic surface 302 to form a hydrophobic, conductive barrier on the metallic surface 302. In the example of FIG. 3, two terminal dithiocarbamate groups bind the organic, conductive material to the metallic surface 302 and simultaneously allow charge transfer to occur from the conductive, organic material to the metallic surface 302. In a particular embodiment, the metallic surface 302 of FIG. 3 may be a porous metallic surface that may be generated using techniques previously described herein with respect to FIG. 1.

Prophetic Example: Synthetic Procedure

Step 1: Synthesis of 1,4-Dibromo-2,5-bis(2-trimethylsilylethynyl)benzene (4). Trimethylsilylacetylene (2.1 eq.), PdC12(PPh3)2 (2.5 mol %), and CuI (5 mol %) may be added to a deaerated solution of 1,4-dibromo-2,5-diiodobenzene (1.0 eq.) in a mixture of solvents that may be a mixture of diisopropylamine and benzene. Alternatives to trimethylsilyacetylene may include other silyl-protected acetylenes, such as TIPS, TBDMS, TES, or TBDPS. The resulting mixture may be stirred for 1 hour at room temperature, may be diluted with water, and may be extracted with ether (×2). The extract may be washed with water (×2) and may be dried ($MgSO_4$). The solvent may be removed in vacuo and the crude residue may be purified by column chromatography with hexane as the eluent.

Step 2: Synthesis of 4,4'-((2,5-bis((trimethylsilyl)ethynyl)-1,4-phenylene)bis(ethyne-2,1-diyl))dianiline. To a stirred solution of dibromo-bis(trimethylsilylacetylene)benzene from the previous step (1.0 eq.), (2.1 eq.), $PdCl_2(PPh_3)_2$ (2.5 mol %), copper(I) iodide (5 mol %) in a mixture of triethylamine and benzene may be sparged and heated at 70° C. under nitrogen for 2 days. The reaction mixture may be quenched with 25 mL of saturated ammonium chloride and extracted with ether (×3). The combined organic layers may be dried with $MgSO_4$ and the solvent may be removed in vacuo. The product may be purified by column chromatography using 1:5 ethylacetate-hexanes as the eluent.

The molecules synthesized from the previous step can be deposited to the metallic particle surface either with the TMS group present or with the TMS groups removed. This group can be removed by mild acidic, basic conditions (if other than TMS, need stronger conditions here, accordingly), or fluoride conditions. The deprotected alkyne groups can be coupled under Glaser or Hay coupling conditions. Glaser would be preferable since it uses catalytic copper(I) rather than stoichiometric copper. Glaser also uses an amine base and oxygen.

Thus, FIG. 3 illustrates an example of a metallic surface that is coated with a conductive, organic material of the present disclosure to form a hydrophobic, conductive barrier on the metallic surface. In a particular embodiment, the metallic surface (e.g., nickel) that is coated with the molecules depicted in FIG. 3 may have a surface that exhibits a "mesh" of apertures no larger than 5-10 micrometers in size, a contact angle greater than 120° (e.g., 150°), and is permeable to gases/non-aqueous mixtures but not aqueous mixtures.

Figure 4:
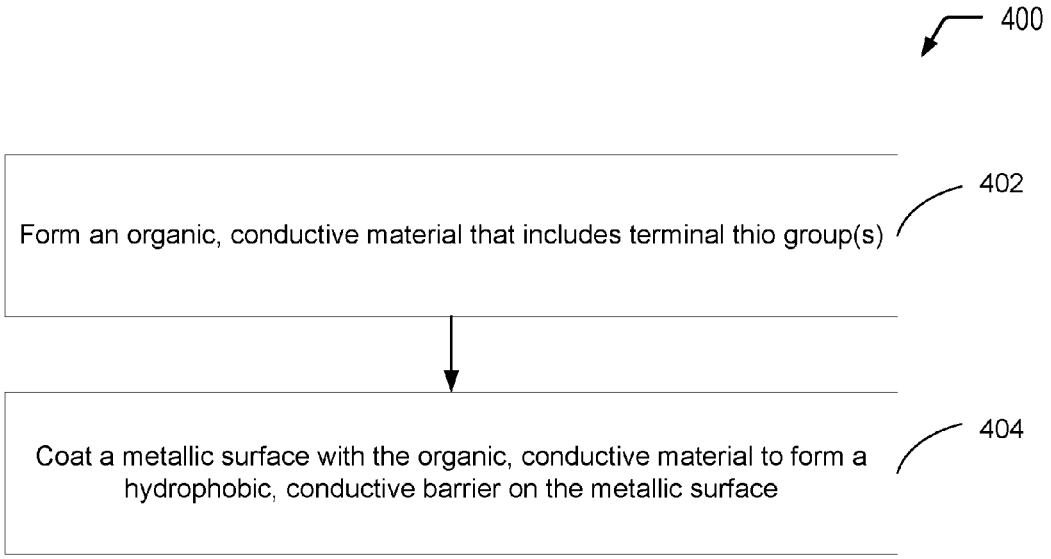
FIG. 4 is a flow diagram showing a particular embodiment of a process of utilizing the organic, conductive materials of the present disclosure as a coating material to form a hydrophobic, conductive barrier on a metallic surface, according to one embodiment.

Referring to FIG. 4, a flow diagram illustrates an exemplary process 400 of utilizing the conductive, organic material(s) of the present disclosure as a coating material to form a hydrophobic, conductive barrier on a metallic surface. In the particular embodiment illustrated in FIG. 4, operations associated with an example process of forming an organic, conductive material that includes one or more thio linkers (e.g., dithiocarbamate linkers in some cases) are identified as operation 402, while operations associated with coating a metallic surface with the organic, conductive material are identified as operation 404. It will be appreciated that the operations shown in FIG. 4 are for illustrative purposes only and that the operations may be performed in alternative orders, at alternative times, by a single entity or by multiple entities, or a combination thereof. As an example, one entity may form the conductive, organic material, another entity may form the metallic material to be coated with the conductive, organic material, while another entity may coat the metallic material with the conductive, organic material.

The process 400 includes forming an organic, conductive material that includes one or more thio linkers, at 402. As an example, the organic, conductive material may include the organometallic material that is formed according to the process described herein with respect to FIG. 1. As another example, the organic, conductive material may include the organic material that is formed according to the process described herein with respect to FIG. 2. As yet another example, the organic, conductive material may include the organic material that is formed according to the process described herein with respect to FIG. 3.

The process 400 includes coating a metallic surface with the organic, conductive material, at 404. The organic, conductive material forms a hydrophobic, conductive barrier on the metallic surface. As an example, FIG. 1 illustrates a metallic surface (e.g., nickel) that is coated with a conductive organometallic material that includes a thio linker. As another example, FIG. 2 illustrates a metallic surface (e.g., nickel) that is coated with a conductive, organic material that includes a single dithiocarbamate linker. As a further example, FIG. 3 illustrates a metallic surface (e.g., nickel) that is coated with a conductive, organic material that includes two dithiocarbamate linkers. In some cases, the metallic surface may be coated with various combinations of the conductive, organic materials depicted in FIGS. 1-3.

In a particular embodiment, the conductive, hydrophobic metallic surface formed according to the process 400 depicted in FIG. 4 may satisfy particular performance characteristics. As an example, a metallic surface (e.g., nickel) that is coated with the conductive, organic materials of the present disclosure may have a surface that exhibits a "mesh" of apertures no larger than 5-10 micrometers in size, a contact angle greater than 120° (e.g., 150°), and may be permeable to gases/non-aqueous mixtures but not aqueous mixtures.

It will be understood from the foregoing description that modifications and changes may be made in various embodiments of the present invention without departing from its true spirit. The descriptions in this specification are for purposes of illustration only and are not to be construed in a limiting sense. The scope of the present invention is limited only by the language of the following claims.

What is claimed is:

1. A process of forming a hydrophobic, conductive barrier on a metallic surface, the process comprising:

depositing a solution containing an organic, conductive material onto a metallic surface, the organic, conductive material comprising:

a conductive group including two or more alkyne groups; and a dithiocarbamate group to bind the organic, conductive material to the metallic surface, wherein the organic, conductive material forms a hydrophobic, conductive barrier on the metallic surface.

2. The process of claim 1, wherein the conductive group includes a multi-[(porphinato)metal] oligomer.

3. The process of claim 1, wherein the organic, conductive material includes a derivative of a bipyridyl-dinitro oligophenyleneethynylene (BPDN) molecule, the BPDN molecule modified to replace a terminal thiol group with the dithiocarbamate group.

4. The process of claim 1, wherein the organic, conductive material includes a molecule having a first terminal alkyne group and a second terminal alkyne group, the first terminal alkyne group of the molecule to be joined to an alkyne group of a second molecule and the second terminal alkyne group of the molecule to be joined to an alkyne group of a third molecule.

5. The process of claim 1, wherein the metallic surface includes a nickel surface.

6. The process of claim 1, wherein the organic, conductive material includes two dithiocarbamate groups.

7. An article of manufacture comprising:

a metallic material;

an organic, conductive material bound to a surface of the metallic material, the organic, conductive material comprising:

a conductive group including two or more alkyne groups; and a dithiocarbamate group to bind the organic, conductive material to the surface of the metallic material, wherein the organic, conductive material forms a hydrophobic, conductive barrier on the surface of the metallic material.

8. The article of manufacture of claim 7, wherein the surface of the metallic material includes a micro-porous or nano-porous metallic surface.

9. The article of manufacture of claim 7, wherein the conductive group includes one of:

a multi-[(porphinato)metal] oligomer; or a derivative of a bipyridyl-dinitro oligophenyleneethynylene (BPDN) molecule, the BPDN molecule modified to replace a terminal thiol group with the dithiocarbamate group.

10. The article of manufacture of claim 7, wherein the metallic material includes a nickel material.

11. The article of manufacture of claim 7, wherein the surface of the metallic material includes a plurality of apertures, each aperture of the plurality of apertures having a size in a range of 5 micrometers to 10 micrometers.

12. The article of manufacture of claim 7, wherein the surface of the metallic material has a contact angle that is greater than 120°.

13. The article of manufacture of claim 12, wherein the surface of the metallic material has a contact angle of about 150°.

14. The article of manufacture of claim 7, wherein the surface of the metallic material is permeable to gaseous materials, but not to aqueous materials.

15. A process of forming an article of manufacture having a porous, hydrophobic metallic surface, the process comprising:

forming a porous metallic material; and depositing a solution containing an organic, conductive material onto a surface of the porous metallic material to form a hydrophobic, conductive barrier on the surface of the porous metallic material, the organic, conductive material comprising:

a conductive group including two or more alkyne groups; and a dithiocarbamate group to bind the organic, conductive material to the surface of the porous metallic material.

16. The process of claim 15, wherein the porous metallic material includes a porous nickel material.

17. The process of claim 15, wherein the porous, hydrophobic metallic surface of the article of manufacture includes a plurality of apertures, each aperture of the plurality of apertures having a size in a range of 5 micrometers to 10 micrometers.

18. The process of claim 15, wherein the porous, hydrophobic metallic surface of the article of manufacture has a contact angle that is greater than 120°.

19. The process of claim 15, wherein the porous, hydrophobic metallic surface of the article of manufacture is permeable to gaseous materials, but not to aqueous materials.

20. The process of claim 15, wherein the porous, hydrophobic metallic surface of the article of manufacture includes a micro-porous or nano-porous metallic surface.

* * * * *